US005182415A

United States Patent [19]

Kunimoto

[11] Patent Number: 5,182,415

[45] Date of Patent: Jan. 26, 1993

[54] MUSICAL TONE SYNTHESIZING DEVICE

[75] Inventor: Toshifumi Kunimoto, Hamamatsu, Japan

[73] Assignee: Yamaha Corporation, Hamamatsu, Japan

[21] Appl. No.: 781,811

[22] Filed: Oct. 23, 1991

[30] Foreign Application Priority Data

Oct. 24, 1990 [JP] Japan ..... 2-286831

[51] Int. Cl.[5] ..... G10H 1/08; G10H 1/12

[52] U.S. Cl. ..... 84/660; 84/661; 84/696; 84/DIG. 9; 84/DIG. 10

[58] Field of Search ..... 84/622-625, 84/630, 659-665, 692-700, 707, 735-741, DIG. 9, DIG. 10, DIG. 26

[56] References Cited

U.S. PATENT DOCUMENTS 4,548,119 10/1985 Wachi et al. ..... 84/DIG. 9

4,984,276 1/1991 Smith ..... 84/630 X

*Primary Examiner*—Stanley J. Witkowski

*Attorney, Agent, or Firm*—Graham & James

[57] ABSTRACT

A musical tone synthesizing device employing an operator, for generating musical tone signals by a modulation operation process. The device also employs a waveguide combined to the operator, for generating a reciprocating signal including a delay circuit for delaying the signal inputted into the waveguide feedback path, and for feeding back the output signal of the delay means to the signal, reciprocating within the waveguide.

10 Claims, 3 Drawing Sheets

MUSICAL TONE SYNTHESIZING DEVICE

BACKGROUND OF THE INVENTION

1. Field of the Invention

The present invention relates to devices for synthesizing musical tones, and more particularly, to devices which are capable of synthesizing highly complex musical tones.

2. Prior Art

Devices are conventionally known which synthesize the sound of conventional non-electronic musical instruments by electronically simulating the mechanism of sound generation thereof.

Examples of such include devices which simulate the mechanism of sound generation in wind instruments, and thereby synthesize musical tones which simulate the sound of the target wind instrument. In the case of an actual wind instrument, blowing pressurized air from a performer's mouth causes a reed component of the instrument to vibrate in a non-linear manner. This non-linear vibration of the reed acts to create vibrating air pressure waves which propagate within the hollow tubular portion of the wind instrument. The vibrating air pressure waves propagating within the wind instrument in turn interact with the vibrating reed and establish a state of resonance therewith.

With conventional devices which simulate the mechanism of sound generation in wind instruments, typically, a non-linear amplifying element is used to simulate the function of the reed in the target instrument, and a bi-directional transfer circuit simulates the propagation of air pressure waves in the hollow tubular portion of the instrument. One example of this type of conventional musical tone synthesizing device has been disclosed in Japanese Patent Application First Publication, Serial No. Sho-63-40199.

Conventional devices of the type described above, however, have limitations in terms of the fidelity with which they are able to simulate the sound of the target instrument. This problem is particularly troublesome when it is desired to simulate the sound of a wind instrument having a very complicated acoustical output. As an example, closed type networks consisting of a lossless digital waveguide which are often employed in this type of conventional synthesizing device to simulate propagating air pressure waves are frequently not capable of simulating the complex interaction of the propagating air pressure waves in certain types of wind instruments, and therefore, these devices are not able to faithfully simulate the sound of such wind instruments. Moreover, there is an increasing demand for tone synthesizing devices used in electronic musical instruments which can simulate conventional non-electronic musical instruments with very high fidelity.

On the other hand, devices of the type described above are also being developed in a different prior art entitled "Musical tone signal formation device" (U.S. Pat. No. 4,297,933). This prior art addresses the selection of tone quality by utilizing a digital FM formula which generates musical tone signals in accordance with the different algorithms (computational means). However, although this prior art utilizes an FM formula, it is not able to carry out the synthesis of complex musical tones.

SUMMARY OF THE INVENTION

The object of the present invention, taking into consideration the aforementioned problems, is to provide a musical tone synthesizing device that is capable of carrying out the synthesis of highly complex musical tones.

In order to solve the above mentioned problems, the present invention combines a modulation operator unit, which creates predetermined musical tone signals through a modulatory operational process, and a waveguide, constructed in accordance with a closed-type network, in a manner such that a musical tone is synthesized.

In the present invention, the modulation operator unit and the waveguide are combined in an appropriate manner such that synthesis of musical signals can be carried out: for example, such as when the waveguides are inserted in series, or in parallel between the modulation operator units.

Therefore, by combining in an appropriate manner the algorithms of both the modulation operator unit and the waveguide, the carrying out of highly complex musical tones becomes possible.

BRIEF DESCRIPTION OF THE FIGURES

Other aspects and advantages of the present invention will be apparent from the following description and accompanying drawings in which the preferred embodiments are clearly shown.

In the drawings.

DESCRIPTION OF THE PREFERRED EMBODIMENTS

Figure 1:
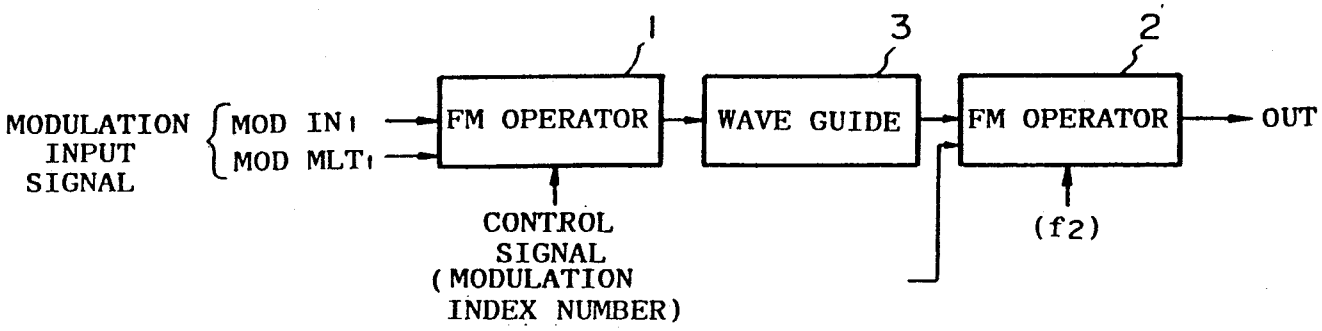
FIG. 1 is a block diagram showing the basic configuration of the musical tone synthesizing device according to the first embodiment of the present invention.
Figure 2:
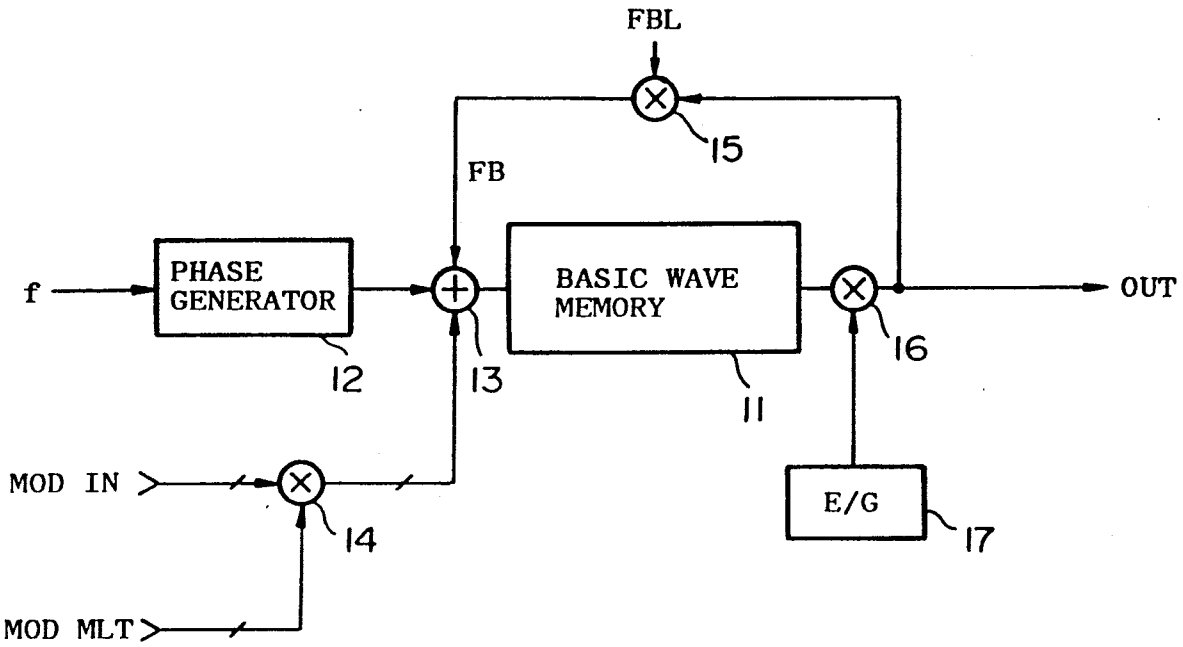
FIG. 2 is a block diagram showing the detailed configuration of the FM operator circuit in the above embodiment.

FIG. 1 is a block diagram showing the basic electrical configuration of the musical tone synthesizing device according to the first embodiment of the present invention. In this embodiment, a waveguide network 3, consisting of a closed type network, is inserted between FM operators 1,2. FM operators 1,2 are similar to the FM operator described in the above mentioned U.S. Pat. No. 4,297,933, and detailed electrical configuration thereof is shown in FIG. 2. As shown in FIG. 2, the FM operator 1 (or 2) comprises a basic wave memory 11, a phase generator 12, an adder 13, multipliers 14–16 and an envelope generator 17. The phase generator 14 generates a phase signal according to a carrier signal "f" (i.e., information on a fundamental frequency of an operator). Modulation input signal "MOD IN" and "MOD MLT" (e.g. modulation index number indicating depth of modulation) are multiplied together by multiplier 14, and then the output signal of multiplier 14 is inputted into the basic wave memory 11 via adder 13. The basic wave memory outputs corresponding waves, and an output wave thereof is multiplied by an envelope signal from envelope generator 17 by a multiplier 16, and as a result, a musical tone output signal is output. Further, the output signal wave form of basic wave memory 11 may be in the form of a sine wave or any other arbitrary wave form.

The musical tone output signal is fed back to the input side of the basic wave memory 11 via multiplier 15, while a portion of feedback signal is controlled by control signal FBL and inputted to multiplier 15. Further, the electrical configuration of other FM operators described below are similar to FM operator 2. In FIG. 1, different carrier signals having different carrier frequencies can be added into the FM operators 1 and 2. In this case, the tone color of the output signal in the preferred embodiment can be variably controlled by the relation of the carrier frequencies (for example, frequency ratio). Further, pitch of the output signal can be controlled by varying the carrier frequencies in accordance with desired pitch.

Figure 3:
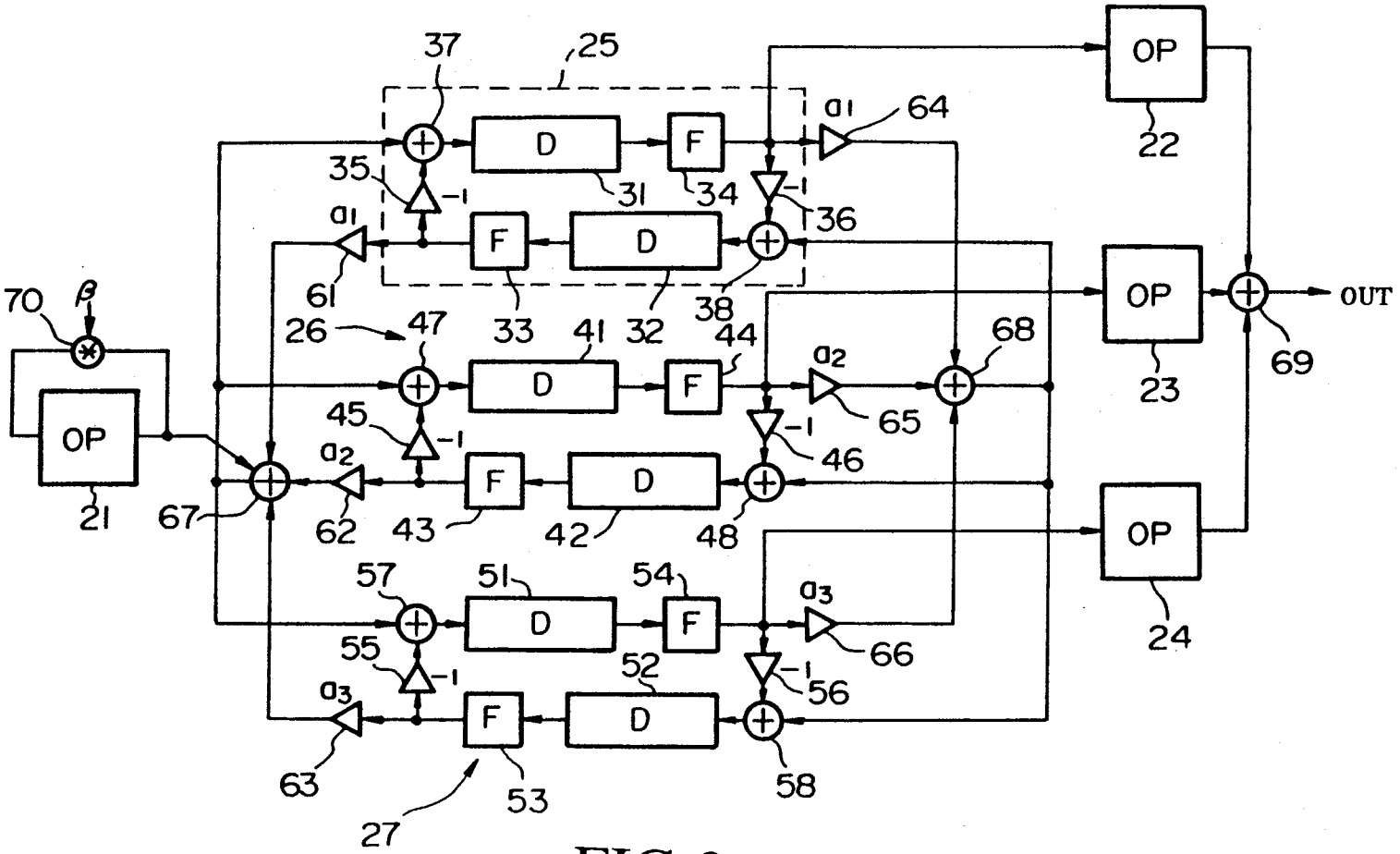
FIG. 3 shows an actual circuit of the musical tone synthesizing device based on the basic principles explained in FIG. 1.

In the following, an actual circuit of the musical tone synthesizing device based on the basic principles explained in FIG. 1 is shown in FIG. 3. In the case of the circuit shown in FIG. 3, each of the three wave guides 25- 27 is inserted respectively between an FM operator 21 and three FM operators 22-24.

A representative waveguide 25 comprised of the following components, delay circuits 31, 32, filter circuit 33, 34, inverters 35, 36 and adders 37, 38, will now be described. Delay circuits 31, 32 include for example a shift register, in which each step of the shift register is determined according to the number of flip-flops in response to the number of bits in the transmission data. Each flip-flop is driven according to a common clock. Additionally, the shift register pair in delay circuits 31, 32 correspond to the resonance frequency. Filter circuits 33, 34 include, for example, low pass filters and, during the resonance phenomenon, simulate the loss of vibrations. Reverse circuits 35, 36 reverse the course of signals within the closed loop, while adders 37, 38 add the input signals inside of the loop.

Similarly, waveguide 26 is comprised of delay circuits 41, 42, filter circuits 43, 44, inverters 45, 46 and adders 47, 48; waveguide 27 is comprised of delay circuits 51, 52, filter circuits 53, 54, inverters 55, 56 and adders 57, 58.

In addition, the other circuit elements contained in FIG. 3 include, multipliers 61-66 which multiply the input data by a fixed attenuation coefficient, adders 67-69 and multiplier 70, which controls the feedback quantity of operator 21.

The function of the example in previous paragraphs will now be further explained using FIG. 3.

In the production of musical tone using this a musical tone synthesizing device, at the beginning when the FM musical tone signal, produced in accordance with FM operator 21, is added to adder 67, this signal is inputted through adder 67 to every waveguide 25-27.

To state an example of the function in waveguide 25, the signal inputted into delay circuit 31 is first delayed by a fixed time period. That zone is restricted by filter circuit 34, and then inputted into inverter 36. The signal, reversed by inverter 36, is then delayed a second time by delay circuit 32, the zone is restricted by filter circuit 33, and then fed back to adder 37 through inverter 35. In this manner, the reciprocating phenomenon of the vibrations in any kind of physical oscillating body, is simulated. The reciprocating movements of signals can even be carried out by waveguides created by different channels.

On the other hand, the output signals of filter circuits 34, 44, 54 are multiplied by the dissipation factors $a_1$, $a_2$, $a_3$ according to each multiplier 64-66, and after being combined by adder 68, are then inputted into adders 38, 48, 58 respectively. Similarly, the output signals of filter circuits 33, 43, 53 are multiplied by the dissipation factors $a_1$, $a_2$, $a_3$ according to each multiplier 61-63, and after being combined by adder 67, are then inputted into adders 37, 47, 57 respectively. Consequently, in each waveguide 25-27, over time, the gradually decreasing movement of the transmission signal is repeated. When the sound attenuation of, for example a percussion instrument, is simulated, the musical tones synthesized in adder 69 are finally produced as a resultant output through FM operators 22-24. In the present example, FM operators 21-24 and wave guides 25-27 are combined and form what is known as the algorithm of the musical tone synthesis. The signals produced in FM operator 21 are synthesized in a complex manner according to the three wave guides 25-27. Furthermore, the management of the FM sound source can be carried out through FM operators 22-24. As a result, following along the lines of recent demands, the carrying out of highly complex musical tone synthesis is possible. Additionally, in FM operators 21, 22-24 and waveguides 25-27, through the appropriate modulation of the circuit constants, as a link to sound structure, the production of complex and interesting sounds unattainable in the prior art is possible. For example, in the delay circuit, it is permissible to change the delay command: in response to this change of the delay command it is also permissible to carry out what is known as key scaling. Every part of the coefficient can also be appropriately changed.

Figure 4:
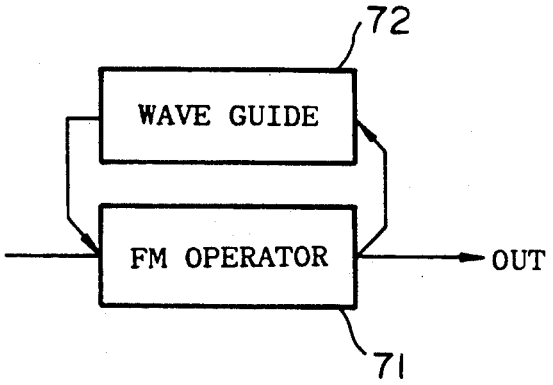
FIG. 4 is a block diagram showing basic configuration of the musical tone synthesizing device according to the second embodiment of the present invention.
Figure 5:
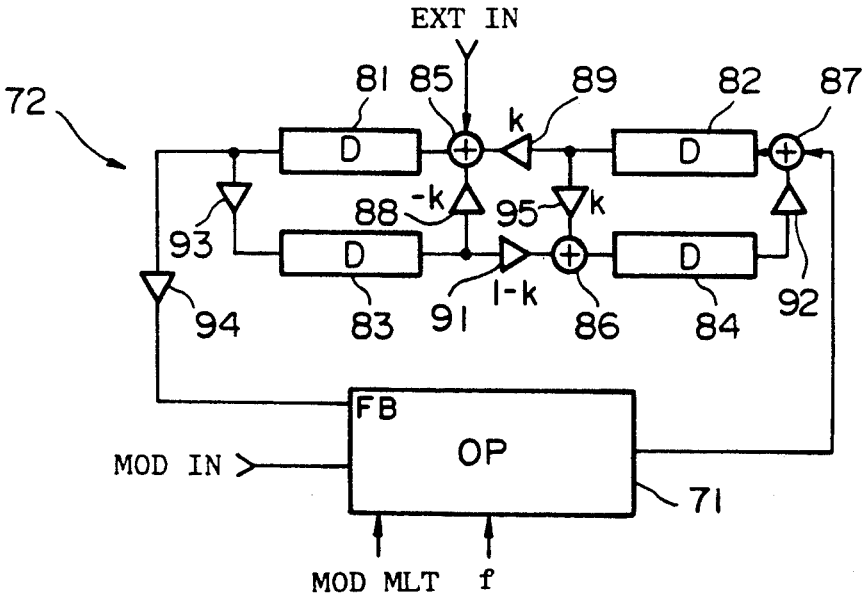
FIG. 5 is a block diagram showing the detailed configuration of the wave guide in the second embodiment.

In the following, FIG. 4 is a standard block diagram describing example 2 of the present invention in which waveguide 72 was inserted parallel to FM operator 71. Waveguide 72, the details of which are shown by FIG. 5, is comprised of multipliers 89-94 having dissipation factors K, 1-K, delay circuits 81-84, adders 85-87 and inverter 88. Further, external control signal EXT.IN is inputted into adder 85; feedback signal control can also be controlled in waveguide 72.

Consequently, in the present example, the signal produced by operator 71 is fed back through waveguide 72. When this happens, the amount of feed back is controlled using external control signal EXT.IN. Accordingly, in the present invention highly complex musical tones unattainable in the prior art can be produced.

What is claimed is:

1. A musical tone synthesizing device comprising:

modulation operation means for generating a modulated musical tone waveform signal in accordance with an inputted modulation signal; and a waveguide, coupled with said modulation operation means, for generating a signal reciprocating therein, comprising:

delay means for delaying a signal inputted into said waveguide; and a feed back path for feeding back an output signal of said delay means to an input of said delay means to thereby form a closed loop.

2. A musical tone synthesizing device in accordance with claim 1 wherein said waveguide is inserted in series into a feedback channel of said modulation operation means.

3. A musical tone synthesizing device according to claim 1, wherein said operation means performs a frequency modulation operation and generates signals, the frequencies of which are modulated in accordance with said modulation signal, as said modulated musical tone waveform signal.

4. A musical tone synthesizing device comprising:

a plurality of modulation operation means for generating plural musical tone signals by a modulation operation process; and a waveguide connected between two of said operation means for generating a reciprocating signal, said waveguide comprising:

delay means for delaying a signal inputted into said waveguide; and a feed back path for feeding back an output signal of said delay means to an input of said delay means to thereby form a closed loop.

5. A musical tone synthesizing device according to claim 4 wherein said operation means perform frequency modulation operations and generate signals, the frequencies of which are modulated in accordance with said modulation signal, as said modulation musical tone waveform signals.

6. A musical tone synthesizing device comprising:

modulation operation means for generating a musical tone signal by a modulation operation process; and a plurality of waveguides provided in parallel and connected to said modulation operation means, for generating a reciprocating signal, each of said plurality of waveguides comprising:

delay means for delaying a signal inputted into said waveguide; and a feed back path for feeding back an output signal of said delay means to an input of said delay means to thereby form a closed loop.

7. A musical tone synthesizing device in accordance with claim 6, wherein said waveguide further comprises:

two groups of circuits, each having an adder, a delay circuit and a filter circuit connected in series;

a first inverter which reverses the output of a first of said circuit groups and then outputs it to said adder in a second of said circuit groups;

a second inverter which reverses the output of the second circuit group and then outputs it to said adder in said first circuit group.

8. A musical tone synthesizing device in accordance with claim 6 wherein said waveguide further comprises control means for controlling the feedback amount.

9. A musical tone synthesizing device in accordance with claim 8 wherein said control means controls the feedback amount based on an external control signal.

10. A musical tone synthesizing device according to claim 6, wherein said operation means perform a frequency modulation operation and generates a signal, the frequencies of which are modulated in accordance with said modulation signal, as said modulated musical tone waveform signals.

* * * * *